United States Patent [19]

Akahane

[11] 4,142,360

[45] Mar. 6, 1979

[54] ELECTRONIC TIMEPIECE

[75] Inventor: Yoshikazu Akahane, Suwa, Japan

[73] Assignee: Kabushiki Kaisha Suwa Seikosha, Tokyo, Japan

[21] Appl. No.: 813,732

[22] Filed: Jul. 7, 1977

[51] Int. Cl.[2] ..... G04C 3/00

[52] U.S. Cl. ..... 58/23 R; 58/85.5

[58] Field of Search ..... 58/23 R, 23 AC, 85.5, 58/50 R; 307/220 R, 225; 73/6

[56] References Cited

U.S. PATENT DOCUMENTS

| | | | |
|---|---|---|---|
| 3,975,898 | 8/1976 | Nishimura | 58/23 R |
| 3,999,370 | 12/1976 | Morokawa et al. | 58/23 R |
| 4,015,208 | 3/1977 | Hammer et al. | 328/39 |
| 4,015,419 | 4/1977 | Morokawa et al. | 58/23 R |
| 4,051,663 | 10/1977 | Chihara et al. | 58/26 R |
| 4,067,187 | 1/1978 | Sekiya et al. | 58/23 R |
| 4,068,462 | 1/1978 | Duff et al. | 58/23 AC |

*Primary Examiner*—Robert K. Schaefer
*Assistant Examiner*—Vit W. Miska
*Attorney, Agent, or Firm*—Blum, Moscovitz, Friedman & Kaplan

[57] ABSTRACT

Control circuitry for an electronic timepiece that is capable of producing a signal representative of the timing rate of the electronic timepiece's time standard and the amount that the timing rate of the electronic timepiece is varied, is provided. Control circuitry is positioned intermediate divider circuitry capable of producing an adjusted low frequency time signal and a time display that displays time in response to the adjusted low frequency signal being applied thereto. The control circuitry is adapted to apply the adjusted low frequency time signal produced by the divider circuit to the display. The control circuit is further coupled to timing rate adjustment circuitry for adjusting the timing rate of low frequency time signal produced by the divider circuitry, in order to produce a signal representative of the timing rate of the time standard and of the amount of adjustment of the timing rate of the low frequency time signal affected by the timing rate adjustment circuitry.

11 Claims, 6 Drawing Figures

ELECTRONIC TIMEPIECE

BACKGROUND OF THE INVENTION

This invention relates to a control circuit for an electronic timepiece, and in particular, to a control circuit for producing a signal representative of the timing rate of the high frequency time standard signal produced by the oscillator circuitry of the electronic timepiece, and the amount that the timing rate, produced by the oscillator circuitry, is adjusted in order to effect an accurate display of time.

In order to permit low frequency time signals, produced by the divider circuitry in an electronic timepiece, to be accurately adjusted, frequency adjustment circuits for varying the frequency or timing rate of the electronic timepiece circuitry have been provided. Such frequency or timing rate adjustment circuitry is utilized with divider circuitry formed from a plurality of series-connected divider stages that are utilized to divide down a high frequency time standard signal produced by an oscillator circuit including a vibratory time standard, and produce a low frequency time signal having a timing rate equal to the frequency rate of the signal produced by the oscillator circuitry divided down by the division ratio determined by the number of divider stages. Frequency adjustment circuitry is utilized to adjust the divided down low frequency time signal, produced by the divider circuitry, by varying the division ratio of the divider stages.

Accordingly, at the time that the electronic timepiece is assembled, the frequency adjustment circuitry, which usually takes the form of a binary logic memory, can be preset and thereby automatically adjust the low frequency time signal produced by the divider circuitry. Alternatively, the frequency adjustment circuitry can be set by the actual operation of the timepiece, and automatically adjust the timing rate of the low frequency time signal produced by the divider circuitry. Therefore, once the assembly of the electronic timepiece is completed, if the timing rate of the low frequency time signal is either preset in error, or the automatic adjustment is in error, it is difficult to measure the error and make the necessary adjustments to the electronic timepiece circuitry to avoid same. This difficulty is caused, in great measure, by an inability to ascertain the actual rate of the high frequency time standard signal produced by the oscillator circuitry and, additionally, the actual amount of timing rate adjustment effected by the frequency adjustment circuitry. Accordingly, control circuitry for an electronic timepiece that produces a signal representative of the frequency rate of the high frequency time standard signal produced by the oscillator circuitry, and of the amount of adjustment effected by the timing rate adjustment circuitry is desired.

SUMMARY OF THE INVENTION

Generally speaking, in accordance with the instant invention, an electronic timepiece including control circuitry for producing a signal representative of the frequency or timing rate of the oscillator circuitry of a timepiece, and also representative of the amount of adjustment of the timing rate needed to produce a highly accurate low frequency time signal, is provided. The electronic timepiece includes oscillator circuitry for producing a time standard signal having a specific high frequency and divider circuitry, comprised of a plurality of series-connected divider stages, for producing a low frequency time signal in response to the high frequency time standard signal being applied thereto. A display is provided to display actual time in response to the low frequency time signal being applied thereto. Frequency adjustment circuitry is coupled to at least two of the divider stages for adjusting the frequency of the low frequency time standard signal by a predetermined amount. The invention is characterized by control circuitry, disposed intermediate the display and divider circuitry, for applying the adjusted low frequency time signal produced by the divider circuitry to the display. The control circuitry is further coupled to the frequency rate adjustment circuitry and oscillator circuitry and is adapted to produced a signal representative of the specific high frequency of the time standard signal and the amount of adjustment of the low frequency time signal by the frequency adjustment circuitry.

Accordingly, it is an object of the instant invention to provide control circuitry for an electronic timepiece having oscillator circuitry and frequency adjustment circuitry that provides a signal representative of the frequency rate of the oscillator circuitry and of the amount of adjustment to the frequency rate effected by the frequency adjustment circuitry.

A further object of the instant invention is to provide control circuitry for an electronic timepiece that permits the timing rate and the amount by which the timing rate is adjusted in an electronic timepiece to be ascertained without having to disassemble the electronic timepiece.

Still a further object of the instant invention is to provide control circuitry for selectively transmitting a signal representative of the high frequency signal produced by the oscillator circuitry and the amount by which the timing rate of the high frequency signal produced by the oscillator circuitry is adjusted in order to facilitate correction of the accuracy of the electronic timepiece.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 1:
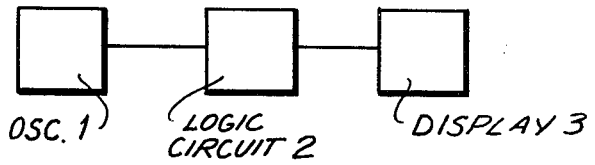
FIG. 1 PRIOR ART
FIG. 1 is a block circuit diagram of an electronic timepiece constructed in accordance with the prior art.

Reference is first made to FIG. 1, wherein an electronic timepiece, constructed in accordance with the prior art and including oscillator circuitry, generally indicated as 1, logic circuitry, including a frequency divider, generally indicated as 2, and a display, generally indicated as 3, is depicted. The oscillator circuit includes a piezoelectric vibrator as a time standard and produces a high frequency time standard signal. For example, quartz crystal vibrators are capable of producing a high frequency time standard signal on the order of $2^{16}$ Hz. The logic circuitry 2 includes a frequency divider that receives the high frequency time standard signal, produced by the oscillator circuitry, and divides same down into a low frequency time signal to be applied to the display 3. If the display is an analog display, an electro-mechanical transducer is utilized to invert the low frequency time signals, produced by the divider circuitry, into an incremental rotary motion for advancing the clock hands. Alternatively, if the display is a digital display comprised of liquid crystal display segments or light emitting diode segments, arranged to define seven-segmented display digits, the display is provided with decoder and driver circuitry for decoding the low frequency time signals produced by the divider circuitry and for energizing the digital display segment to numerically display time in response thereto. Such digital displays are often utilized to display other information, such as calculator information, calendar information, etc.

Accordingly, the accuracy of the timepiece is based, in large measure, on the stability and accuracy of the high frequency time standard signal produced by the oscillator circuitry, and of the ability to adjust the timing rate of the divider circuitry by varying the division ratio of the divider circuitry to thereby produce an adjusted low frequency time signal. With respect to the stability and accuracy of the high frequency time standard signal, such accuracy and stability depends, in large measure, on the sensitivity of the time standard to changes in temperature, shocks and changes in the supply voltage. Nevertheless, oscillator circuits, having temperature compensation means, frequency stabilization means and tuning means have been provided for permitting a substantially stable high frequency time standard signal to be produced. Once a stable high frequency time standard signal is obtainable, further fine adjustment of the accuracy of the timepiece is obtained by providing frequency adjustment circuitry for varying the division ratio of the divider circuitry to thereby adjust the low frequency timing signal produced thereby.

When the electronic timepiece is assembled, adjustment of the timing rate is often effected by tuning the oscillator circuitry to produce a stable high frequency time standard signal and by presetting the frequency adjustment circuitry to effect a predetermined variation of the division ratio of the divider circuitry and, hence, a predetermined amount of adjustment of the timing rate of the low frequency time signal. To this end, programmable memories, formed of binary logic circuitry that is capable of establishing a preset frequency adjustment, are well known in the art, and are preset at the time that the electronic timepiece is assembled. Additionally, memories that can be programmed by utilizing a transmitter remote from the electronic timepiece, or that can be automatically programmed during operation, have also been provided to permit adjustment of the accuracy of the timepiece during use and repair thereof. It is noted however that once the electronic timepiece is in use, adjustment of the timing rate or frequency by the frequency adjustment circuitry is frustrated by an inability to ascertain the exact frequency of the high frequency time standard signal produced by the oscillator circuitry, and the amount of frequency adjustment that is being effected at the time that frequency is being adjusted. These difficulties in permitting electronic timepieces, and in particular small-sized electronic timepieces such as wristwatches and the like, from being accurately adjusted has considerably limited their acceptance in the marketplace. Accordingly, the instant invention is particularly characterized by control circuitry for an electronic timepiece having frequency adjustment circuitry that can produce a signal that can be readily received by an external apparatus and that is indicative of the frequency of the high frequency time standard signal produced by the oscillator circuit, and the amount of frequency adjustment effected by the frequency adjustment circuitry.

Figure 2:
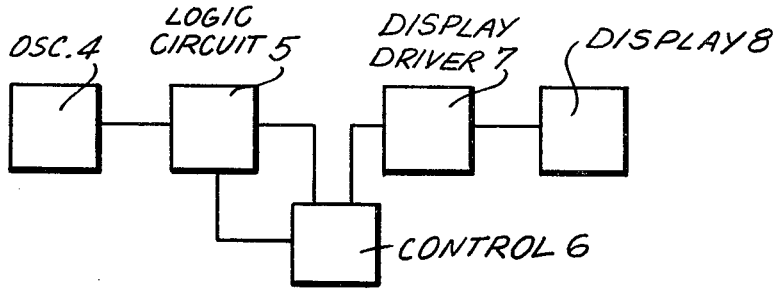
FIG. 2 is a block circuit diagram of a control circuit for an electronic timepiece constructed in accordance with a first embodiment of the instant invention.

Reference is now made to FIG. 2, wherein a block diagram illustrating the manner in which the control circuitry is coupled to the logic circuitry, in a first embodiment, in order to provide an indication signal representative of the high frequency time standard signal, and the amount that the timing rate thereof is adjusted by the frequency adjustment circuitry, is depicted. The oscillator circuitry, generally indicated as 4, applies to a logic circuit, generally indicated as 5, a high frequency time standard signal. The logic circuit includes a frequency divider for dividing down the high frequency time standard signal and for applying a low frequency time signal to a control circuit, generally indicated as 6. Additionally, the logic circuit 5 includes a frequency adjustment circuit for varying the division ratio of the frequency divider circuitry to thereby produce an adjusted low frequency time signal. The control circuitry is coupled to the frequency divider and to the frequency adjustment circuit of the logic circuitry and is adapted to apply the adjusted low frequency time signal to a display driver 7 for driving a display 8 to display actual time in accordance with the adjusted low frequency time signal produced by the logic circuitry. The control circuit is adapted to also produce an indication signal representative of the frequency of the high frequency time standard signal, produced by the oscillator circuit 4, and also representative of the amount of frequency adjustment of the timing rate effected by the frequency adjustment circuitry. In the exemplary embodiment depicted in FIG. 4, the control circuitry inhibits driving of the display during a brief interval of the period of the low frequency time signal, and during that brief interval, produces the indication signal representative of the timing rate of the high frequency time standard signal produced by the oscillator circuitry and the amount that the timing rate is adjusted by the frequency adjustment circuitry.

Figure 4:
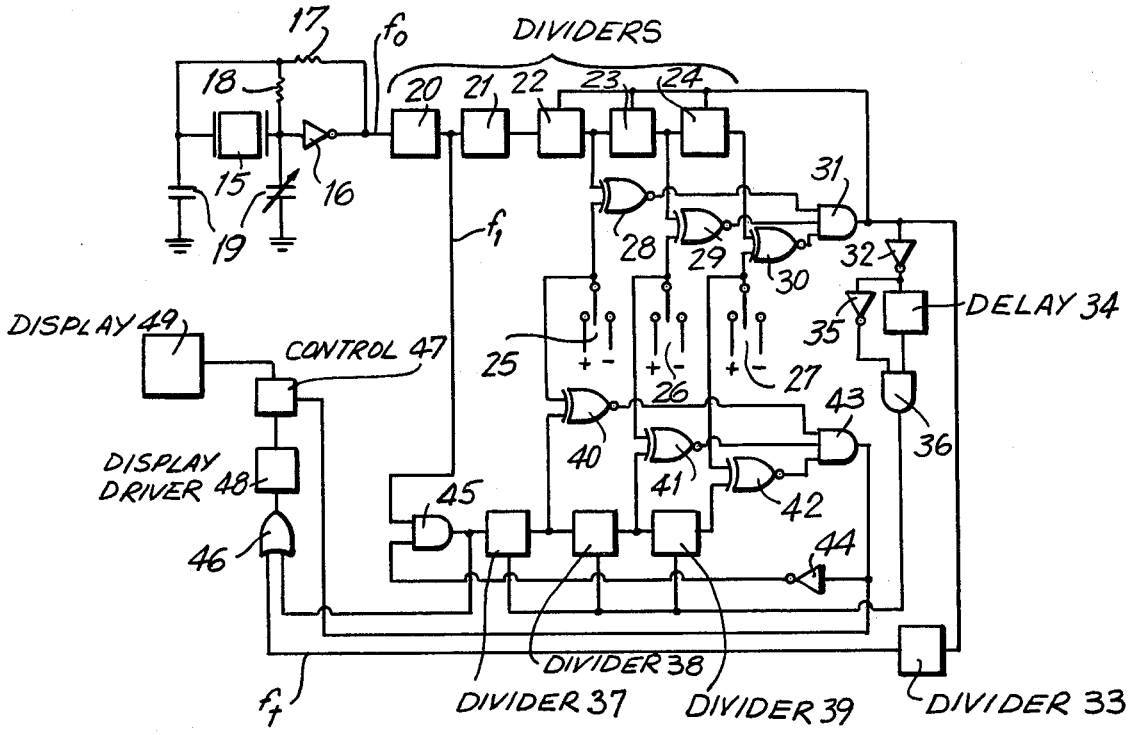
FIG. 4 is a detailed circuit diagram of a control circuit of the type depicted in FIG. 2.

Referring now to FIG. 4, an exemplary embodiment of control circuitry for effecting the operation detailed above is depicted. The oscillator circuitry includes a piezoelectric vibrator 15 as a time standard. The oscillator circuitry is of the type well known in the art and includes a C-MOS inverter having the drain terminals thereof commonly coupled through the series connection of a phase control resistor 17, series-coupled to the parallel connection of a feed back resistor 18 and piezoelectric vibrator 15 to the gate input terminal in order to produce a high frequency time standard signal. The specific frequency of the high frequency time standard signal is selected by a tuning capacitor 19, coupled between the gate input terminal and a reference terminal, such as ground. Stabilization of the specific high frequency time standard signal, with respect to changes in ambient temperature, is effected by providing a temperature compensating capacitor 19. Accordingly, the oscillator circuitry produces a high frequency time standard signal $f_0$, which signal is applied to divider circuitry including series-connected divider stages 20 through 24 and a further divider 33, which divider circuitry divides down the high frequency time standard signal $f_0$ and produces a low frequency time signal $f_t$.

Frequency adjustment circuitry including EXCLUSIVE NOR gates 28 through 30, AND gate 31 and programmable preset terminals 25 through 27, are provided for varying the division ratio of the divider circuitry, to thereby produce an adjusted low frequency time signal $f_t$. Specifically, the programmable preset terminals 25, 26 and 27, are preset to either a positive (+) or negative (−) terminal in order to adjust the division ratio of the divider stages 22, 23 and 24. When the intermediate frequency signals, produced by the divider stages 22, 23 and 24, are coincident with the preset programmed count of the preset programmable terminals 25, 26 and 27, all of the EXCLUSIVE NOR gates 28 through 30 apply HIGH binary state inputs to the AND gate 31, to thereby produce an HIGH binary state output signal at the output thereof. The HIGH binary state signal is applied to the reset terminal R of each of the divider stages 22 through 24, to thereby reset same and, once again, begin their counting cycle. The output signal produced by the AND gate 31 therefore has an adjusted timing rate, and is further divided down by the divider circuitry 33 to produce the adjusted low frequency time signal $f_t$, which signal is applied through an OR gate 46 to a display driver circuit 48. Display driver circuit 48, in response to receiving the adjusted low frequency time signal $f_t$, decodes and drives a digital display 49 formed of liquid crystal or light emitting diode display segments in order to effect a digital display of actual time.

Additionally, the output signal from the AND gate 31 is applied to an inverter 32 of the control circuitry in order to control the operation of the control circuitry. Specifically, divider stages 37, 38 and 39 are substantially identical to the divider stages 22, 23 and 24 of the divider circuitry and are reset to a count of zero in response to the output of the AND gate 31 being changed to a LOW binary state. When the output of AND gate 31 is changed to a LOW binary state, the inverter 32 inverts same and applies the inverted signal through a delay circuit 34 to an AND gate 36. Additionally, the inverted LOW binary level signal, produced by AND gate 31, is applied to inverter 32, inverter 35 and delay 34, in order to produce, at the output of AND gate 36, a reset pulse to be applied to the reset terminals R of the divider stages 37, 38 and 39. Specifically, each time a HIGH binary level signal is applied to the input of the inverter 32, a narrow pulse signal, having a pulse width equal to that produced by the delay circuitry 34, is applied to the reset terminals R of the divider stages 37, 38 and 39 to thereby reset same to a count of zero. Coupled to the outputs of divider stages 37, 38 and 39 are EXCLUSIVE OR gates 40, 41 and 42 and AND gate 43 in the same manner as the EXCLUSIVE NOR gates 28, 29 and 30 are coupled to the divider stages 22, 23 and 24. Moreover, a second input of each of the EXCLUSIVE NOR gates 40, 41 and 42 is respectively coupled to the preset programmable terminals 25, 26 and 27 in order to detect when the count of the divider stages 37, 38 and 39 are coincident with the binary state of the preset programmable terminals. Accordingly, if the preset programmable terminals 25, 26 and 27 are set to a binary count other than zero, when the divider stages 37, 38 and 39 are reset to zero, a LOW binary level signal will be produced at the output of AND gate 43, inverted by inverter 44, and applied as a high binary state gating signal to AND gate 45. When the HIGH binary state gating signal is applied to AND gate 45, high frequency signal $f_1$, produced by divider 20, is applied to the divider stages 37, 28 and 39 until the binary states of same are coincident with the binary states of the preset programmable terminals 25, 26 and 27. When the counts of the respective divider stages 37, 28 and 39 are coincident with the binary states of the preset programmable terminals 25 through 27, a HIGH level signal is produced at the output of the AND gate 43, and is inverted by the inverter 44 to thereby prevent the high frequency signal $f_1$ from being further applied to the divider stages 37 through 39, and thereby clamp same at the coincident count until a reset pulse is again applied to the reset terminals R thereof. Accordingly, the output signal produced by the AND gate 43 will be a LOW level signal only for the period required for the divider stages 37, 38 and 39 to be rapidly advanced to the coincident count by the application of the high frequency signal $f_1$ thereto. The LOW level output signal from the AND gate 43 is applied to control circuit 47 for a period equal to the time required for the divider stages 37 through 39 to reach the coincidence count. At all other times, the control circuit 47 receives the HIGH binary state signal produced by the AND gate 43 and, in response thereto, permits the display 49 to display time in response to the adjusted low frequency time signal $f_t$ being applied through OR gate 46 to the driver circuitry. However, when the LOW level binary state signal, produced by AND gate 43, is applied to the control circuitry 47, the control circuitry 47 not only prevents the time from being displayed, but also transmits a signal having the frequency of the high frequency time signal $f_1$ for a period of time required for the divider stages 37, 38 and 39 to be advanced from a count of zero to a coincidence count by the high frequency signal $f_1$.

Accordingly, the control circuit 47 is an impedance control circuit that effects an impedance match of the output from the driver circuitry 48 and from the AND gate 43 in order to perform two specific functions. The first function is to transmit a magnetic field, electrical field, audio or optical signal to a measuring apparatus remote from the timepiece having a frequency equal to the high frequency time signal $f_1$ and having a duration equal to the time required for the divider stages 37, 38 and 39 to be advanced to the coincidence count, and secondly to inhibit the driver circuitry from driving the display 49 during the relatively brief interval that the control circuitry 47 is transmitting the signal. It is noted that the frequency of the high frequency time signal $f_1$ is of a much greater magnitude than the adjusted low frequency time signal $f_t$ and, therefore, will advance the divider stages 37, 38 and 39 of the control circuitry to a coincidence count in a sufficiently short interval of time so that the short time over which the display is inhibited is not perceived as a result of retinal retention.

Moreover, by transmitting a signal for an interval of time, determined by divider stages 37, 38 and 39, which divider stages are substantially identical to divider stages 22 through 24, and by determining the coincidence count of the divider stages 37 through 39 by coupling the EXCLUSIVE NOR gates 40 through 42 to the same preset terminal as the EXCLUSIVE NOR gates 28 through 30, the interval over which the indication signal is transmitted, by the control circuit 47, is proportional to the amount that the low frequency time signal is adjusted by the division ratio adjustment circuitry coupled to divider stages 22 through 24. Accordingly, by transmitting an indication signal having a frequency equal to the high frequency signal $f_1$ for an interval determined by advancing the divider stages 37 through 39 to the same coincidence count as the divider stages 22 through 24, the frequency rate of the electronic timepiece circuitry and the amount of adjustment can readily be determined by a measuring instrument remote from the timepiece.

Figure 5:
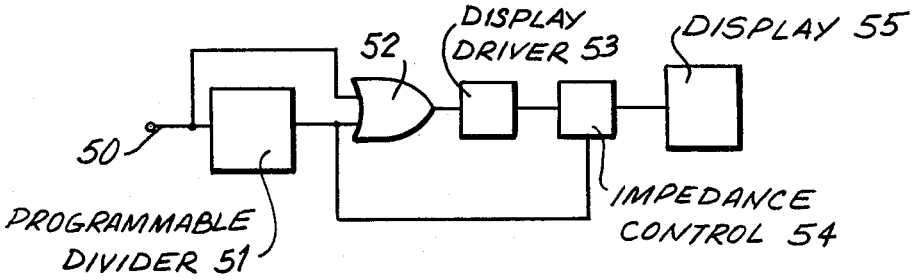
FIG. 5 is a block circuit diagram of the control circuitry depicted in FIG. 4.

Turning now to FIG. 5, a block diagram illustrative of the operation of the exemplary embodiment depicted in FIG. 4 is presented. The high frequency time standard signal 50 is applied to the programmable frequency divider 51 and is further applied as a first input to the OR gate 52. The output of the programmable frequency divider is applied as the other input to the OR gate 52 and, additionally, as a control input to the impedance control circuit 54. The output of the OR gate 52 is applied to the display decoder and driver circuitry 53 in order to effect a driving of the display 55 in response to the high frequency time signal being applied through OR gate 52 to the driver 53. However, when the programmable frequency divider 51 produces the opposite state signal for a short interval of time, the impedance control circuitry 54 inhibits the driving of the display 55 and, at the same time, transmits a signal indicative of the amount of adjustment effected to the timing rate of the electronic timepiece and of the unadjusted timing rate of the high frequency time standard signal produced by the oscillator circuitry.

In the exemplary embodiment described above, the impedance control circuitry includes a transmitter for transmitting either a magnetic field, electric field, audio indication or optical indication signal to a receiver remote from the electronic timepiece. Alternatively, the control circuitry need not include a transmitter, and instead the display can be provided with a transmitter or, a alternatively, the display elements can be utilized to effect transmission of the indication signal.

Figure 3:
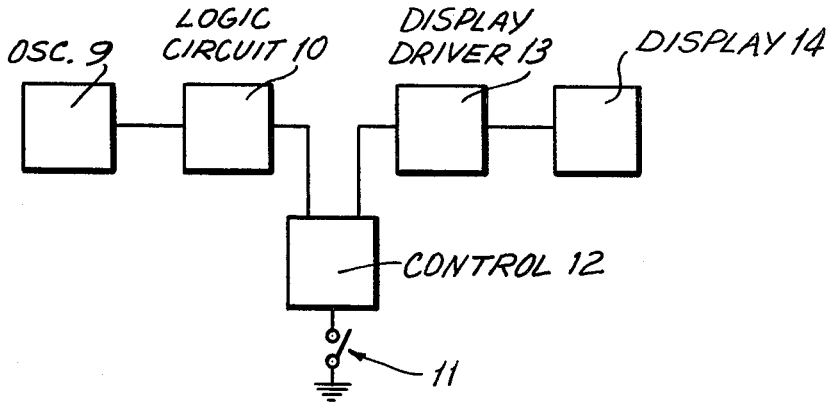
FIG. 3 is a block circuit diagram of a control circuit for an electronic timepiece constructed in accordance with the second embodiment of the instant invention.

Reference is now made to FIG. 3, wherein a block circuit diagram of a control circuit for permitting an indication signal, of the type detailed above, to be selectively transmitted in response to the manual operation of a switch 11, is depicted. Specifically, an oscillator circuit 9 applies a high frequency time standard signal to logic circuit 10, which logic circuit includes a frequency divider and frequency adjustment circuit. The control circuit 12 is coupled to the logic circuit 10 and produces a signal representative of the amount of frequency adjustment effected by the frequency adjustment circuitry therein. Display driver 13 is adapted to drive a digital display 14. In addition to providing a display of time, the display 14 can also be utilized, in the manner detailed above, to transmit the signal indicating the amount of frequency adjustment of the timing rate effected. However, in the embodiment depicted in FIG. 3, the manually operated switch 11 insures that this signal is only selectively transmitted when the manually operated switch 11 is actuated, thereby rendering it unnecessary for the driving of the display to be interrupted during each period of the adjusted low frequency time signal in the manner detailed above with respect to the embodiment illustrated in FIGS. 2, 4 and 5.

Figure 6:
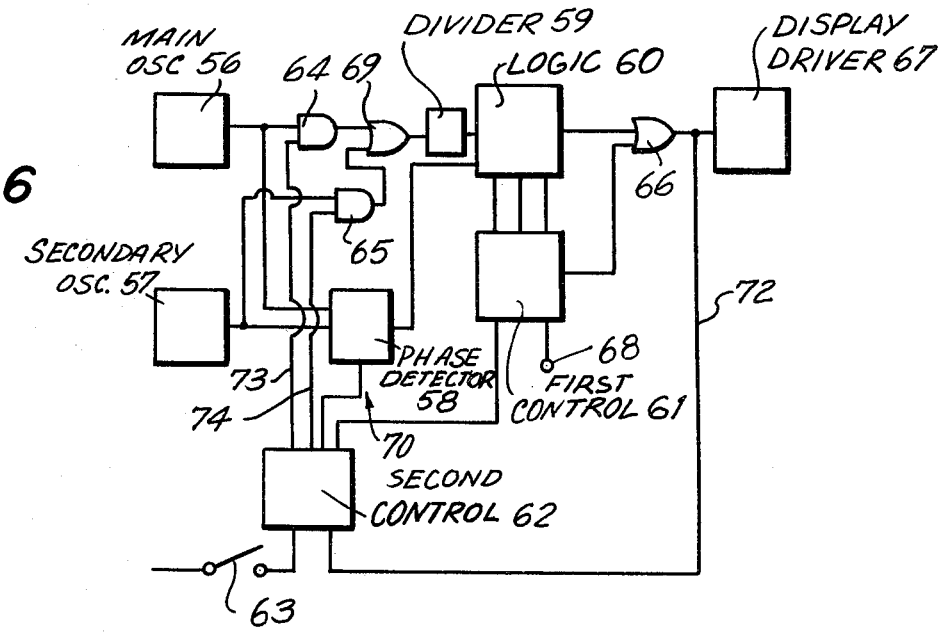
FIG. 6 is a detailed circuit diagram of the control circuitry depicted in FIG. 3.

Reference is now made to FIG. 6, wherein an exemplary embodiment of the instant invention, illustrating the control circuitry of the type detailed above that can be utilized in timepiece circuitry having more than one oscillator circuit, is depicted. Specifically, the electronic timepiece circuitry, illustrated in FIG. 6, includes a main oscillator circuit 56 having a first piezoelectric vibrator time standard and a secondary oscillator circuit 57 having a second piezoelectric vibrator time standard coupled in a known circuit arrangement for adjusting the timing rate of the high frequency time standard signal produced by the oscillator circuitry in order to eliminate inaccuracies therein caused by the inherent temperature characteristics of the piezoelectric vibrator time standards. Specifically, the main oscillator circuit 56 produces a first high frequency time standard signal that is applied to divider 59 and is divided down by divider 59 and thereafter is applied to logic circuit 60, which circuit includes frequency divider circuitry and frequency adjustment circuitry for advancing or retarding the frequency rate of the adjusted low frequency time signal produced thereby. Similarly, the secondary oscillator circuit 57 produces a second high frequency time standard signal that, in combination with the first high frequency time standard signal, produced by the main oscillator 56, is applied to a phase detection circuit 58, which circuit detects when the second high frequency time standard signal is out of phase with the first high frequency time standard signal by a predetermined interval, and in response thereto applies a phase derection signal to the logic circuitry 60. The frequency adjustment circuit 16, effects adjustment of the low frequency time signal either by adding or deleting a pulse therefrom in response to the phase detection signal being applied thereto. Electronic timepiece circuitry, including a main oscillator 56, secondary oscillator 57, phase detection circuit 58, divider 59 and phase detector 60, are described in detail in Japanese patent application no's 77579/76 and 81357/76, which applications form the basis for applicant's pending U.S. application no. 811,808, filed on June 30, 1977, and claiming the priority of both Japanese applications. Applicant's co-pending U.S. aplication no. 811,808 is incorporated by reference, as if fully set forth herein, in order to provide a detailed explanation of the manner in which the main oscillator circuitry and secondary oscillator circuitry effects adjustment of the frequency rate of the low frequency time standard signal. Accordingly, the temperature adjusted low frequency time standard signal is applied through OR gate 66 to a display driver 67 to effect a display of actual time in response thereto. Also, the display driver circuitry 67 can include transmission circuitry capable of transmitting an indication signal of the type detailed above, when same is applied to the display driver circuitry 67 through the OR gate 66, in a manner to be described in greater detail below.

Coupled to the logic circuit 60 is a first control circuit 68, which control circuit is substantially identical to the control circuitry comprised of the elements having the reference numerals 37 through 45 in the exemplary embodiment, depicted in FIG. 4, and functions in the same manner to apply an indication of signal through the OR gate 66 to the display driver circuitry 67 in the same manner that the indication signal is applied by the control circuitry comprised of elements 37 through 45 in FIG. 4. However, a second control circuit 62 is coupled to the first control circuit 61 and permits the first control signal, indicative of a specific frequency rate and the amount of temperature adjustment imparted to the low frequency time signal, to be applied through OR gate 66, only when the manually operated switch 63, coupled to the second control circuit 62, is suitably actuated. Moreover, production of the indication signal by the first control circuit 61, during the proper interval of the adjusted low frequency time signal, is assured by applying the output signal 72, produced by the OR gate 66, to the second control circuit 62 in order to assure that synchronization is effected therebetween. Accordingly, the second control circuit 62 has a first control output 73 coupled to an AND gate 64, which AND gate includes, as a second input, the first high frequency time standard signal produced by main oscillator 56. A second control signal 74 is produced by the second control circuit 62 and is applied to a first input of AND gate 65, which AND gate receives as a second input the second high frequency time standard signal produced by the secondary oscillator 56. Finally, a third output signal 70 is produced by the second control circuit 62 and is applied to the phase detecting circuitry 58. Accordingly, actuation of the manually operated switch 63 is adapted to sequence the second control circuit through at least three specific conditions. In the first condition, inhibit signals are applied to the first input of AND gate 65 and to the phase detection circuitry 58, and thereby permits an indication signal to be produced by the first control circuit 61 that is indicative of the timing rate of the high frequency time standard signal produced by the main oscillator 56 and transmitted through AND gate 64. In a second condition, an inhibit signal is applied to AND gate 64 and phase detecting circuitry 58, and thereby permits a second indication signal, produced by the second control circuit 61, to be representative of the timing rate of the second high frequency time standard signal produced by the secondary oscillator 57. In a third condition, regular operation of the temperature compensation circuitry is permitted, and a third indication signal, produced by the first control circuit 61, represents the amount of temperature compensation of the timing rate adjustment effected. Accordingly, operation of the second control circuit 61 is controlled by operating manually operated switch 63 and by applying the appropriate clock pulse 68 being measured thereto (not shown). Thus, the first indication signal produced by the second control circuit 61 is representative of the timing rate of the first high frequency time standard signal produced by the main oscillator circuit. The second indicator signal is representative of the second high frequency time standard signal produced by the secondary oscillator circuit. The third indication signal is representative of the amount of temperature adjustment of the timing rate. From this information an appropriate measuring instrument, including a receiver, can receive the time indication signals and determine the information necessary to permit the accuracy to be adjusted. As noted above, additional transmitting means, such as an antenae or the like, or the optical elements utilized to effect a digital display, can be utilized to transmit the information contained in the indication signals produced by the first control circuit 61.

Accordingly, the instant invention is particularly characterized by control circuitry that permits an indication signal to be produced that is representative of the timing rate of the high frequency time standard signal and of the amount of adjustment to the low frequency time signal derived therefrom. By providing such correction circuitry, repair and/or adjustment of the electronic timepiece can be facilitated, by utilizing measuring instruments having an appropriate receiver, so that measurement instrumentation need not be included in the electronic wristwatch. The facility with which the timing rate can be adjusted, by utilizing the instant invention, permits the cost of owning and maintaining an electronic timepiece to be reduced, which is certain to contribute to the wider acceptance of same in the marketplace.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. In an electronic timepiece including oscillator means for producing a time standard signal having a specific high frequency, divider means including a plurality of series-connected divider stages for producing a low frequency time signal in response to said time standard signal being applied thereto, display means for displaying actual time in response to said low frequency time signal being applied thereto and frequency adjustment means coupled to at least two of said divider stages for adjusting the frequency of said low frequency time signal, the improvement comprising control means disposed intermediate said display means and said divider means, said control means being adapted to apply said adjusted low frequency time signal produced by said divider means to said display means, said control means being further coupled to said frequency adjustment means for producing an indication signal representative of the amount of adjustment to said low frequency time signal and the specific frequency of a time standard signal produced by said oscillator means.

2. An electronic timepiece as claimed in claim 1, wherein said frequency adjustment means includes comparator means adapted to be set to a specific coincidence count, said comparator means being adapted to reset each of the divider stages coupled thereto in response to detecting a coincidence in the count of said divider stages and the set coincidence count of said comparator means to thereby adjust the timing rate of said low frequency time signal.

3. An electronic timepiece as claimed in claim 2, wherein said comparator means is adapted in response to detecting a coincidence between the set count of said comparator means and said divider stages coupled thereto to apply an intermediate frequency signal to at least one further divider stage, the output of said at least one further divider stage being said low frequency time signal.

4. An electronic timepiece as claimed in claim 3, wherein said control means includes at least two further divider stages and a further comparator means, said comparator means and further divider stages being substantially identical to said first mentioned comparator means and divider stages coupled thereto, said further divider stages being adapted to be reset to a count of zero in response to said intermediate frequency signal being applied thereto and to receive said high frequency time standard signal produced by said oscillator means, said further divider stages in response to said time standard signal being advanced until the count thereof is coincident with the preset count of said further comparator means, said further comparator means in response to detecting said coincidence count between same and said further divider stages, being adapted to inhibit the application of said high frequency time standard signal to said divider stages, whereby the time interval required for said further comparator means to be advanced to the coincident count of said comparator means is proportional to the time required to advance said first-mentioned divider stages to the coincidence count of said first-mentioned comparator means, and transmitting means coupled to said comparator means for receiving and transmitting said high frequency time standard signal during the period that same is applied to said further divider stages, said transmitted signal being representative of the specific frequency of said time standard signal, and the amount of frequency adjustment of said low frequency time signal effected by said frequency adjustment means.

5. An electronic timepiece as claimed in claim 4, wherein said first-mentioned comparator means includes a plurality of preset terminals referenced to one of a first binary condition and second binary condition to define said set coincidence condition, each of said terminals being associated with a particular divider stage coupled to said comparator means.

6. An electronic timepiece as claimed in claim 5, wherein said further comparator means is coupled to each of said preset terminals of said first-mentioned comparator means in order to define the same coincidence count for said further divider stages as the coincidence count of said first-mentioned divider stages.

7. An electronic timepiece as claimed in claim 4, wherein said comparator means includes a first gating means disposed intermediate said oscillator means and said transmitting means, said gating means being adapted to transmit said time standard signal to said transmitting means in response to detecting the resetting of said further divider stages by said intermediate frequency signal until said further divider stages are advanced to said coincident count of said further comparator means, whereafter said gating means inhibits the application of said high frequency time standard signal to said transmitting means.

8. An electronic timepiece as claimed in claim 7, wherein said comparator means produces a coincidence signal when said further divider stages are at said coincidence count, said control means including a second gating means for receiving said coincidence signal, said second gating means being further adapted to receive said time standard signal when same is gated through said first gating means and said adjusted low frequency time signal, and in response to said coincidence signal being applied thereto, apply said low frequency time signal to said display means, said second gating means being further adapted to inhibit said low frequency timekeeping signals from being applied to said display means in the absence of said coincidence signal being applied thereto.

9. An electronic timepiece as claimed in claim 1, wherein said control means include a manually actuated switch means, said manually actuated switch means being adapted to selectively produce said indication signal in response to said switch means being manually actuated.

10. An electronic timepiece as claimed in claim 1, wherein said oscillator means comprises a main oscillator means including a first time standard having a first temperature characteristic, said oscillator means being adapted to produce a first high frequency time standard signal having a first predetermined frequency rate determined at least in part by the temperature characteristic of said first time standard, a second oscillator means including a second time standard having a second temperature characteristic, said second oscillator means being adapted to produce a second high frequency time standard signal having a second predetermined frequency determined at least in part by the temperature characteristic of said second time standard signal, phase detection means for producing a phase detection signal in response to detecting a predetermined difference in phase between said first high frequency time standard signal and second high frequency time standard signal in response thereto for applying a phase detection signal to said frequency adjustment means to adjust the frequency of said low frequency time signal produced by said divider means in response to said phase detection signal being applied thereto, said indication signal being representative of the amount that said low frequency time signal is adjusted in response to said phase detection signal being applied to said frequency detection means and the respective frequencies of said first and second high frequency time standard signals.

11. An electronic timepiece is claimed in claim 10, wherein the specific frequency of said time standard signal applied to said divider means is said first high frequency time standard signal, and a second control means is disposed intermediate said main oscillator means, secondary oscillator means and phase detection means for permitting said indication signal to be representative of one of the frequency of said first time standard signal, the frequency of the second time standard signal, and amount of frequency adjustment effected in response to the differences in phase between said first and second time standard signals.

* * * * *